US009002245B2

(12) United States Patent
Takeuchi

(10) Patent No.: US 9,002,245 B2
(45) Date of Patent: Apr. 7, 2015

(54) IMAGE FORMING APPARATUS

(71) Applicant: Canon Kabushiki Kaisha, Tokyo (JP)

(72) Inventor: Yasushi Takeuchi, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 190 days.

(21) Appl. No.: 13/711,350

(22) Filed: Dec. 11, 2012

(65) Prior Publication Data

US 2013/0149013 A1 Jun. 13, 2013

(30) Foreign Application Priority Data

Dec. 13, 2011 (JP) ..... 2011-272763

(51) Int. Cl.
*G03G 15/16* (2006.01)
*G03G 15/02* (2006.01)

(52) U.S. Cl.
CPC ..... *G03G 15/0283* (2013.01); *G03G 15/1695* (2013.01)

(58) Field of Classification Search
USPC ..... 399/296, 297
See application file for complete search history.

(56) References Cited

U.S. PATENT DOCUMENTS 5,857,135 A * 1/1999 Hayashida et al. ..... 399/296

FOREIGN PATENT DOCUMENTS

| | | | |
|---|---|---|---|
| JP | 8-63003 | A | 3/1996 |
| JP | 2005-181906 | A | 7/2005 |
| JP | 2009-69456 | A | 4/2009 |

* cited by examiner

*Primary Examiner* — David Bolduc
*Assistant Examiner* — Barnabas Fekete
(74) *Attorney, Agent, or Firm* — Canon U.S.A., Inc. IP Division

(57) ABSTRACT

In an image forming apparatus, a voltage applied to a pre-transfer charger is set to the highest voltage, and is then reduced at a position corresponding to a predetermined range from a leading edge of a recording material, to suppress a phenomenon of backward scattering of toner formed just before entering a transfer nip, when a burr formed on the leading edge of the recording material exits the transfer nip.

9 Claims, 19 Drawing Sheets

IMAGE FORMING APPARATUS

BACKGROUND OF THE INVENTION

1. Field of the Invention

The present invention relates to an image forming apparatus, including a copying machine, a printer, and a facsimile apparatus, that forms a toner image made on an image bearing member such as a photosensitive member, on a recording material. In particular, the present invention relates to a transfer device that transfers the toner image to the recording material.

2. Description of the Related Art

In a transfer nip that nips a recording material and electrostatically transfers a toner image to the recording material, a pre-transfer charging unit that charges toner on a photosensitive drum before transfer is provided to adjust a charge amount of the toner.

Japanese Patent Application Laid-Open No. 2005-181906 discusses a configuration in which a pre-transfer charger increases a charge amount to suppress toner scattering.

A bulge referred to as a burr is formed at an edge of a recording material as a cutting trace that is generated when the recording material is cut to a predetermined size. If the bulge at a leading edge of the recording material enters the transfer nip, an interval between the image bearing member and a transfer member is pushed out and widened. The interval can turn back under pressure of a spring applied to the transfer member when the bulge is out of the transfer nip. As a consequence, an undesirable impact can be made.

If the bulge is formed at the leading edge of the recording material, the toner on the image bearing member just before the bulge enters the transfer nip can be scattered. It is advantageous that the charge amount of the toner image is increased before the transfer to suppress the toner scattering. However, if the charge amount is continuously large, the lifetime of the charger can be shortened because the charger easily gets dirty with the toner.

SUMMARY OF THE INVENTION

According to the present invention, an image forming apparatus includes a movable image bearing member, an image forming unit configured to form a toner image on the image bearing member, a pre-transfer charging member configured to charge the toner image of the image bearing member, facing the image bearing member on a downstream side of the image forming unit in a movement direction of the image bearing member, a power supply configured to apply a voltage to the pre-transfer charging member, and a transfer member configured to form a transfer nip for transferring the toner image of the image bearing member to a recording material by pressing the image bearing member on a downstream side of the pre-transfer charging member in the movement direction of the image bearing member, and an execution unit configured to set a position of the image bearing member on an upstream side in the movement direction of the image bearing member, apart by a length corresponding to the transfer nip from a position of the image bearing member overlapping with a leading edge of the recording material at the transfer nip, as a first position, set a position on an upstream side at a predetermined distance which is shorter than a length of the recording material, from the first position, as a second position, and set a region of the image bearing member between the first position and the second position as a specific region, and execute a mode for setting a voltage of the power supply applied to the pre-transfer charging member as a first voltage in a period during which the specific region passes through at least a position facing the pre-transfer charging member and setting a voltage of the power supply applied to the pre-transfer charging member as a second voltage whose absolute value is lower than that of the first voltage after the second position of the image bearing member passes through the position facing the pre-transfer charging member.

According to the present invention, backward-scattering of the toner formed just before entering the transfer nip when the burr formed at the leading edge of the recording material exits the transfer nip, is suppressed.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
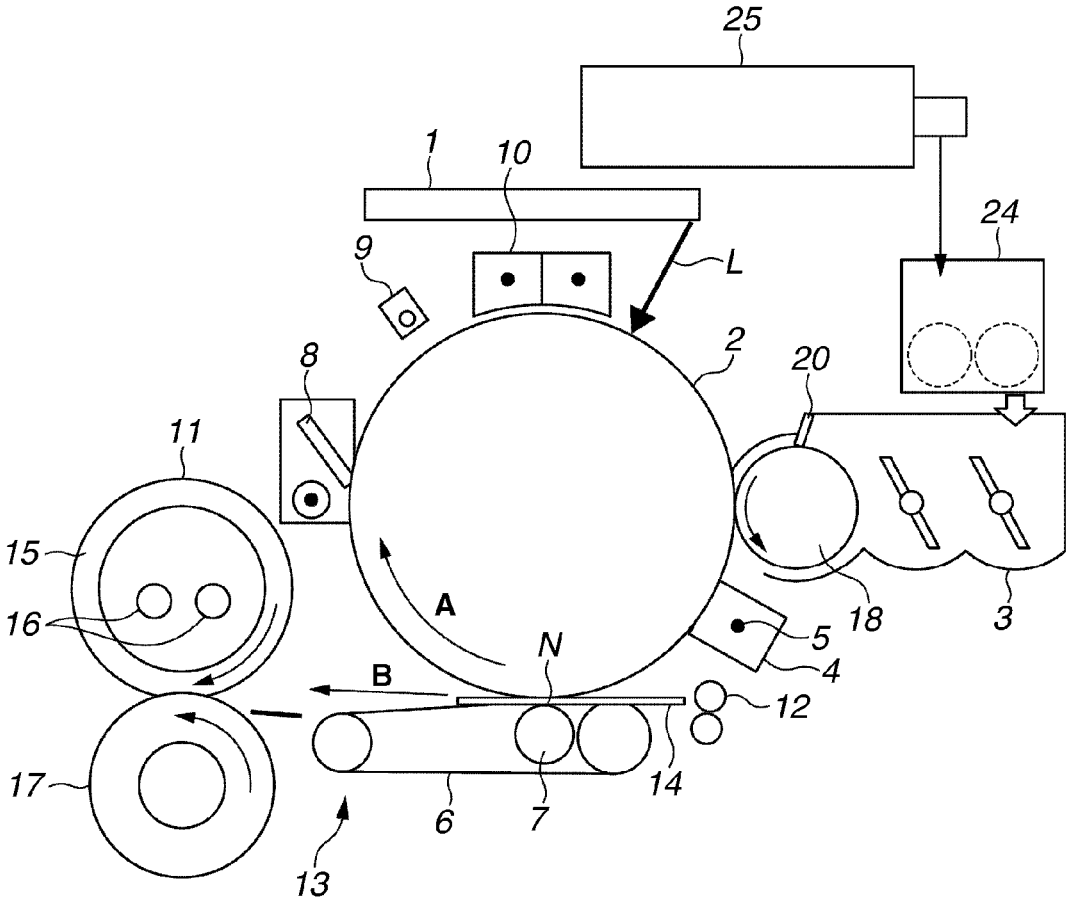
FIG. 1 illustrates a schematic configuration of an image forming apparatus according to a first exemplary embodiment of the present invention.

A configuration of an image forming apparatus is described with reference to FIG. 1 according to a first exemplary embodiment of the present invention. The image forming apparatus includes a photosensitive drum 2 as an image bearing member movable in a (clockwise) direction of an arrow A. The photosensitive drum 2 includes along the movement direction A of the photosensitive drum 2, a primary charger 10 that charges the photosensitive drum 2, an exposure device 1 that exposes the photosensitive drum 2, a developing device 3 that develops a toner image, and a pre-transfer charger 4 that charges the toner image on the photosensitive drum 2 before transfer.

Further, the image forming apparatus includes a transfer conveyance belt 6 that conveys a recording material 14, and a transfer roller 7 that transfers the toner image to the recording material 14. The transfer conveyance belt 6 is stretched between a tension roller 13 that applies tension to the transfer conveyance belt 6 and a drive roller that drives the transfer conveyance belt 6.

Furthermore, the image forming apparatus includes a density detection sensor that detects the density of the toner image, a cleaning device 8 that cleans the photosensitive drum 2 after the transfer, and a discharging exposure lamp 9 that discharges a surface of the photosensitive drum 2. In addition, a fixing device 11 that fixes the toner image on the recording material 14 is arranged downstream of the transfer conveyance belt 6 in a recording material conveyance direction B to convey the recording material 14. The fixing device 11 includes a fixing roller 15, a halogen heater 16 arranged in the fixing roller 15, and a pressing roller 17.

(Outline of Image Forming Operation)

Now, an image forming operation is described. According to the present exemplary embodiment, magnetic toner with the negative polarity is used. The photosensitive drum 2 is moved at a predetermined circumferential velocity (process speed) in the (clockwise) direction of the arrow A driven by a drive device (not illustrated). Charging bias is applied to the primary charger 10, and an electric charge is thus applied to the surface of the photosensitive drum 2 to the potential of a predetermined polarity.

The exposure device 1 exposes the charged surface of the photosensitive drum 2 with light L corresponding to image information. The potential at the exposed portion is reduced and an electrostatic latent image corresponding to the input image information is formed on the surface of the photosensitive drum 2. The toner charged with the same polarity (negative polarity) as the charging polarity of the photosensitive drum 2 by the developing device 3 adheres to the electrostatic latent image, and the toner image is thus visualized.

The pre-transfer charger 4 increases the charge amount of the toner image formed on the photosensitive drum 2. A voltage applied to the pre-transfer charger 4 has the same polarity as that of the toner. According to the present exemplary embodiment, the polarity (charging polarity) of the toner is the negative. Therefore, the voltage applied to the pre-transfer charger 4 has the negative polarity.

The recording material 14 is carried by the transfer conveyance belt 6, and is conveyed to a transfer nip N. A registration control device 12 adjusts timing for conveying the recording material 14 to synchronize with timing for conveying the toner image. When the recording material 14 passes through the transfer nip N, transfer bias of the opposite polarity (positive polarity) of the toner is applied to the transfer roller 7, thereby transferring the toner image to the recording material 14.

The recording material 14 after the transfer is conveyed to the fixing device 11. A fixing nip formed by the fixing roller 15 and the pressing roller 17 nips the recording material 14, which is heated and pressed by the rollers. As a consequence, the toner image is fixed on the recording material 14. Then, the recording material 14 is discharged to the outside of the image forming apparatus.

The cleaning device 8 removes and collects the toner that remains on the surface of the photosensitive drum 2 after the transfer. The discharging exposure lamp 9 removes charges remaining on the surface of the photosensitive drum 2.

(Details of Configurations of Image Forming Apparatus)

The details of configurations of the image forming apparatus are described. An a-Si photosensitive member with an outer diameter of 108 mm is used as the photosensitive drum 2. As the pre-transfer charger 4, a corona charger is used.

As the transfer conveyance belt 6, a material containing a proper amount of carbon black is used as an antistatic agent. The material containing carbon black includes various rubbers, or resins, e.g., polyimide, polycarbonate, polyester, polypropylene, polyethylene terephthalate, acrylic, or chloroethylene. A volume resistivity ρ (Ωcm) of the transfer conveyance belt 6 is desirably $10^5 \leq \rho \leq 10^{15}$ (a probe compliant with the JIS-K6911 standard is used with an applied voltage of 100 V, applying time of 60 sec, 23° C., and 50% RH) to improve the transfer property of the toner. In the present exemplary embodiment, the volume resistivity ρ of the transfer conveyance belt 6 is $10^{10}$ (Ωcm) (a probe compliant with the JIS-K6911 standard is used with an applied voltage of 100 V, applying time of 60 sec, 23° C., and 50% RH), and the thickness ranges from 0.1 to 0.7 [mm].

The transfer roller 7 is a conductive spongy rubber roller with an outer diameter of 20 mm and hardness of 30° (a value read with Asker-C and 500 gf load when five minutes have elapsed). The transfer roller 7 is pressed to the photosensitive drum 2 across the transfer conveyance belt 6 by an elastic member such as a rubber. As a result, the transfer nip N is formed to nip the recording material 14 and transfer the toner image to the recording material 14 from the photosensitive drum 2.

At the transfer nip N, the transfer conveyance belt 6 and the transfer roller 7 enter the photosensitive drum 2 side by 2 mm. In the recording material conveyance direction B, a length n of the transfer nip N is 5 mm. The length n of the transfer nip N changes depending on an entrance amount of the transfer conveyance belt 6 to the photosensitive drum 2, and the hardness and the position of the transfer roller 7. The length n of the transfer nip N is not limited to the value described in the present exemplary embodiment.

(Control of Pre-Transfer Charging Voltage)

The configuration of the pre-transfer charger (pre-transfer charging member) 4 is described. The pre-transfer charger 4 includes a tungsten wire electrode 5 with a diameter of 60 μm. AC bias and negative DC bias is superimposed and applied as a pre-transfer charging voltage, to the wire electrode 5. A DC bias component of the pre-transfer charger 4 is subjected to constant current control.

An AC bias component of the pre-transfer charging voltage at an image forming time is subjected to constant voltage control, and has a between-peak voltage of 8.0 KV, a frequency of 1000 Hz, and a rectangular wave of 50% Duty. A DC bias component of the pre-transfer charging voltage at the image forming time is subjected to constant current control, and changes depending on the position on the recording material 14.

Control of the DC bias component of the pre-transfer charger 4 is specifically described. A relation between the DC bias component of the pre-transfer charging voltage and a toner scattering phenomenon is described with reference to FIG. 6. The abscissa in FIG. 6 indicates the DC bias component of the pre-transfer charging voltage. The ordinate in FIG. 6 indicates an average charge amount of the toner before the transfer and a scattering index after the transfer. The scattering index indicates a scattering degree.

The scattering index is obtained by quantifying a measurement result of the number of the toner scattered to the back side in a sub-scanning direction of a horizontal line within a certain area including the horizontal line. Therefore, the larger the scattering index, the more the scattering deteriorates. When the scattering index is 0, the toner scattering does not occur.

Figure 6:
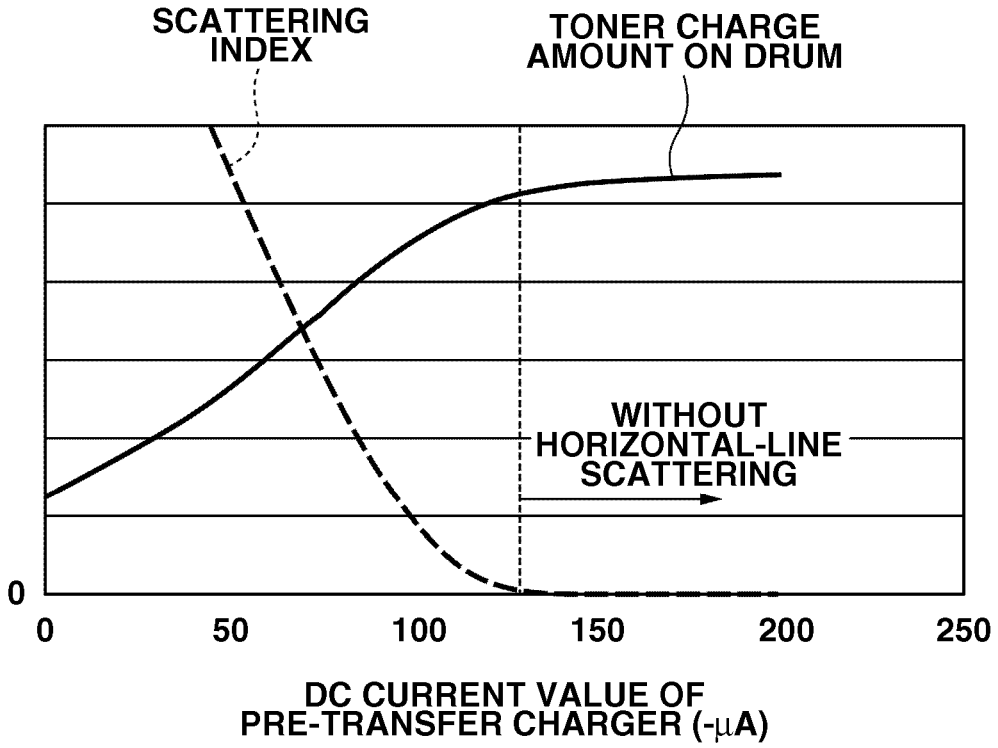
FIG. 6 illustrates a graph of a toner charge amount before transfer and a scattering index after the transfer, relative to a DC bias of a pre-transfer charger according to the first exemplary embodiment.

Referring to FIG. 6, as an absolute value of the DC bias component increases, the toner charge amount before the transfer increases and the scattering index after the transfer decreases. Accordingly, the phenomenon of the horizontal-line scattering does not occur when a DC bias value is −140 μA or more. That is because when the average charge amount of the toner increases, electrostatic cohesion force of the toner increases. Therefore, the image is not easily broken.

Figure 8:
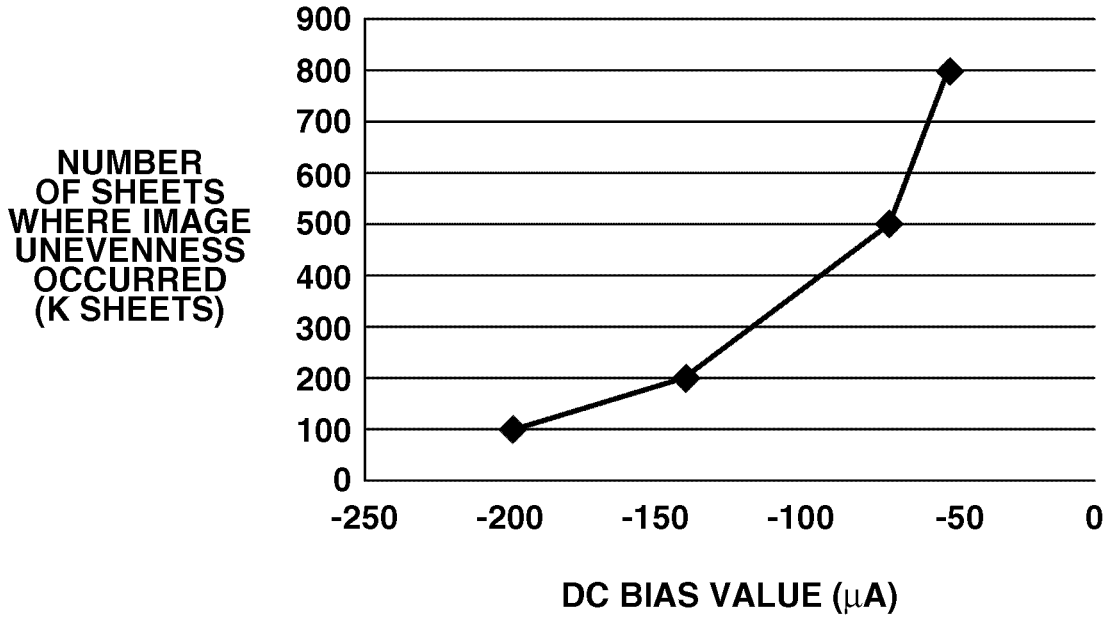
FIG. 8 illustrates a graph of the number of sheets until the image unevenness occurs relative to a set wire current value.

A relation between the DC bias component of the pre-transfer charging voltage and the phenomenon of image unevenness is described with reference to FIG. 8. The abscissa in FIG. 8 indicates the DC bias component of the pre-transfer charging voltage, and the ordinate in FIG. 8 indicates on which sheet the image unevenness occurs. As illustrated in FIG. 8, the larger an absolute value of the DC bias component with the negative polarity, the earlier the timing at which the image unevenness occurs.

Figure 7:
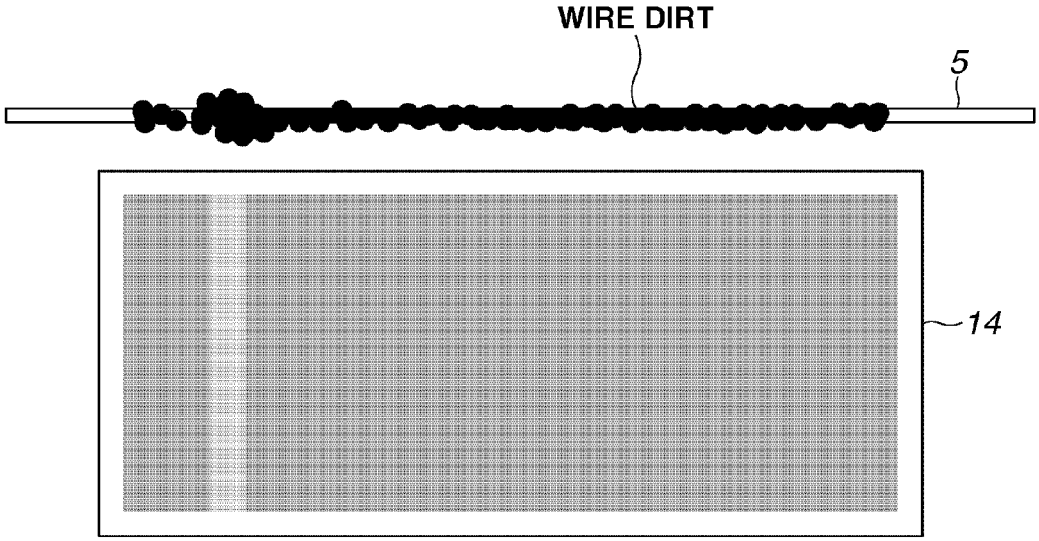
FIG. 7 illustrates a relation between dirt unevenness of a pre-transfer charger wire and image unevenness according to the first exemplary embodiment.

The reason for that phenomenon is that, when the pre-transfer charging voltage with the negative polarity is applied to the pre-transfer charger 4, a positive-charged external additive of the toner is electrostatically attracted to the surface of a wire line, and adheres to the wire. If the dirt uniformly adheres to the wire, the image unevenness is not generated. However, as illustrated in FIG. 7, the dirt on the wire actually has the unevenness. As a consequence, between a portion with a large amount of adhering dirt and a portion with a small amount of adhering dirt, the charge amount applied to the toner is different. Therefore, as compared with the portion with a small amount of dirt, the efficiency for transferring the toner can be reduced and the image can become thin at the portion with a large amount of dirt. That is, the image unevenness can be generated due to the dirt of the wire. The larger the DC bias component of the pre-transfer charging voltage, the larger the amount of dirt adhering to the wire. As a consequence, the timing that the dirt unevenness of the wire occurs becomes earlier and the timing that the image unevenness occurs also becomes earlier.

It is advantageous that the charge of the pre-transfer charging voltage increases, for the purpose of suppressing the toner scattering. However, there is a demerit that the pre-transfer charger 4 becomes dirty earlier. In consideration of the balance therebetween, the DC bias value of the pre-transfer charger 4 should be controlled.

Figure 3:
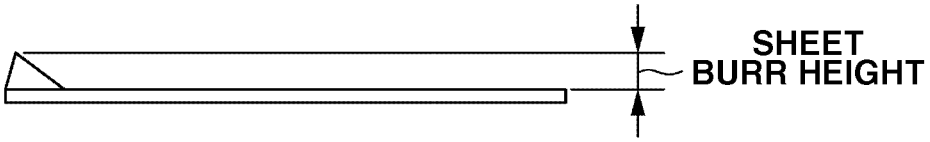
FIG. 3 illustrates a sheet burr according to the first exemplary embodiment.
Figure 4A:
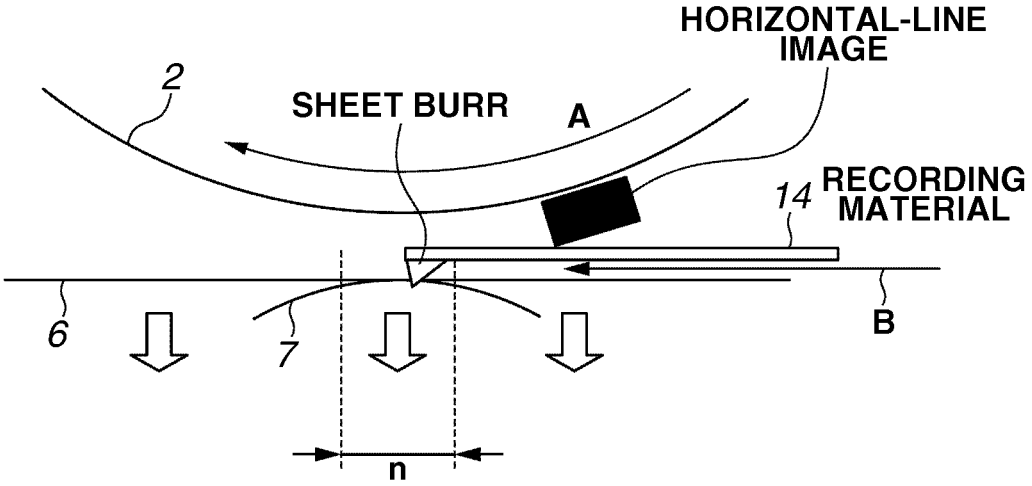
FIGS. 4A and 4B illustrate a mechanism of the horizontal-line scattering according to the first exemplary embodiment.
Figure 4B:
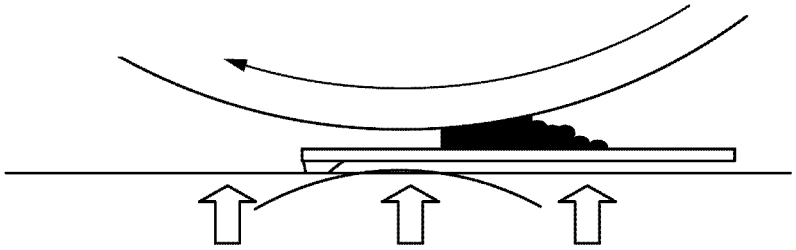

Referring to FIG. 3, the cutting trace may be generated when the recording material 14 is cut with a predetermined size. Namely, a bulge which is referred to as a burr can be formed at an edge of the recording material 14. Referring to FIG. 4A, when the bulge enters the transfer nip N, an interval between the image bearing member and the transfer member is pushed out and widened. The interval turns back by pressure of a spring applied to the transfer member when the bulge exits the transfer nip N (refer to FIG. 4B). Consequently, an undesirable impact can be made. If the bulge is formed at the leading edge of the recording material 14, the toner on the image bearing member just before entering the transfer nip N can be scattered backward.

Figure 2:
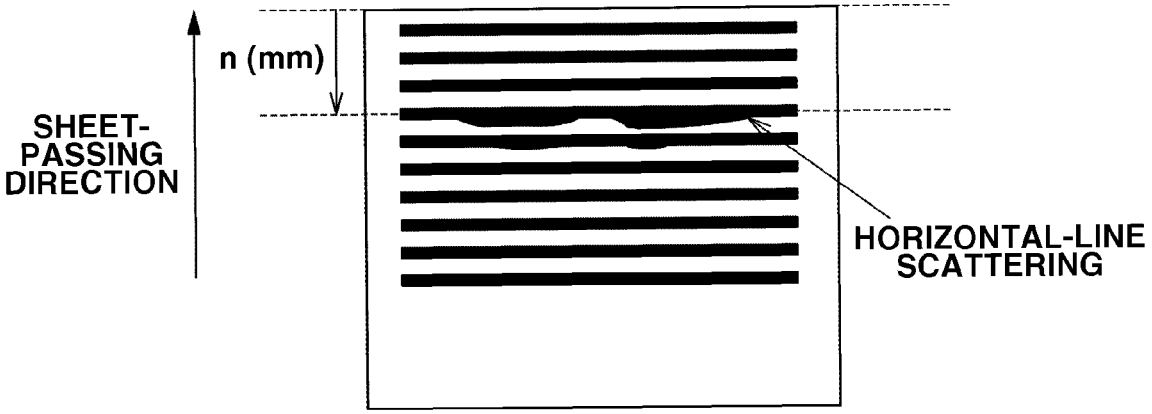
FIG. 2 illustrates a phenomenon of horizontal-line scattering according to the first exemplary embodiment.
Figure 5:
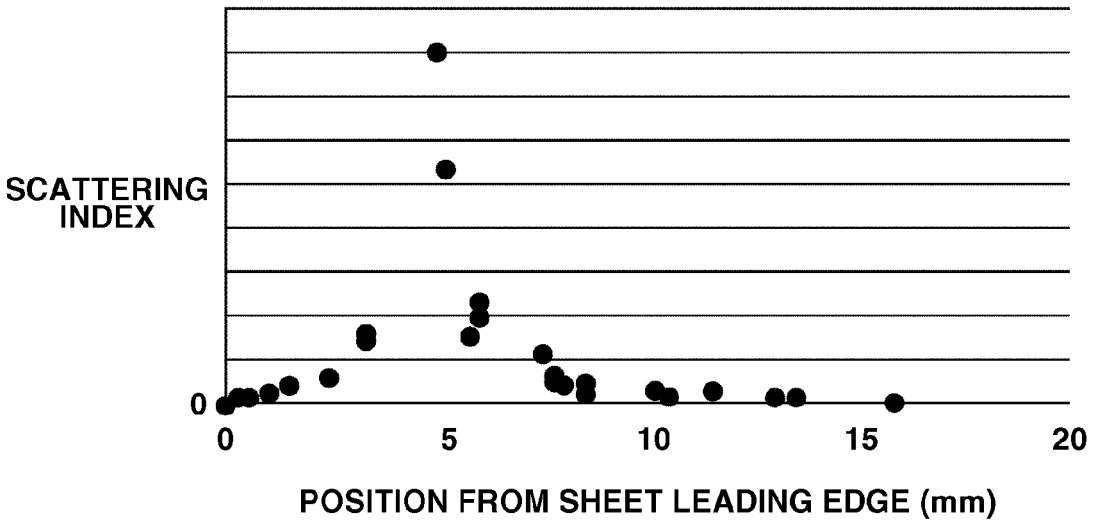
FIG. 5 illustrates a graph of a relation between a sheet position and a horizontal-line scattering index due to the sheet burr according to the first exemplary embodiment.

As illustrated in FIG. 2, if an image formed on the recording material 14 is a horizontal line, the toner can be scattered backward at a position apart a predetermined distance from the leading edge of the recording material 14. FIG. 5 illustrates a relation between the position of the recording material 14 and the scattering index. The abscissa in FIG. 5 indicates the distance from the leading edge of the recording material 14 in the recording material conveyance direction. The ordinate in FIG. 5 indicates the scattering index. The scattering index is obtained by quantifying a measurement result of the number of the toner scattered backward in the sub-scanning direction of the horizontal line within a certain area including the horizontal line.

As illustrated in FIG. 5, the scattering sharply deteriorates at a position apart a predetermined distance (5 mm) from the leading edge of the recording material 14. In a range of not less than 10 mm from the leading edge of the recording material 14, the scattering does not occur. The position of the distance 5 mm where the scattering sharply deteriorates almost matches a length of the transfer nip N in the direction for conveying the recording material 14. The scattering does not occur at a position sufficiently apart from the position corresponding to a distance of the transfer nip N from the leading edge of the recording material 14.

According to the present exemplary embodiment, in order to suppress the backward scattering of the toner when the burr of the recording material 14 exits the transfer nip N, the pre-transfer charger 4 is controlled such that a charge amount (of a specific region) is maximum in a range corresponding to the entire recording material 14. The specific region includes at least a range from a position (first position) apart from the leading edge of the recording material 14 by the distance corresponding to the transfer nip N, to a position (second position) apart a predetermined distance from the first position.

More specifically, an output value Pa of the DC bias component by a distance up to 10 mm from the leading edge of the sheet in the sub-scanning direction is set to −140 μA (first voltage) to suppress the occurrence of scattering at the leading edge. That is because a width of the transfer nip N is 5 mm in the image forming apparatus, and the horizontal-line scanning deteriorates at the leading edge of the recording material 14 at a distance of approximately 5 mm to 10 mm in the sub-scanning direction, as illustrated in FIG. 5. As a consequence, when the burr exits the transfer nip N, backward-scanning of the toner is suppressed.

Further, an output value Pb is set to −70 μA (second voltage) in a range posterior to the second position. In the range posterior to the second position, the toner is hardly scattered. Therefore, even if the output value is small, the toner scattering is not serious. As a consequence, the increase in voltage applied to the pre-transfer charger 4 is suppressed, and the increase in dirt amount adhering to the wire of the pre-transfer charger 4 is also suppressed.

Figure 11:
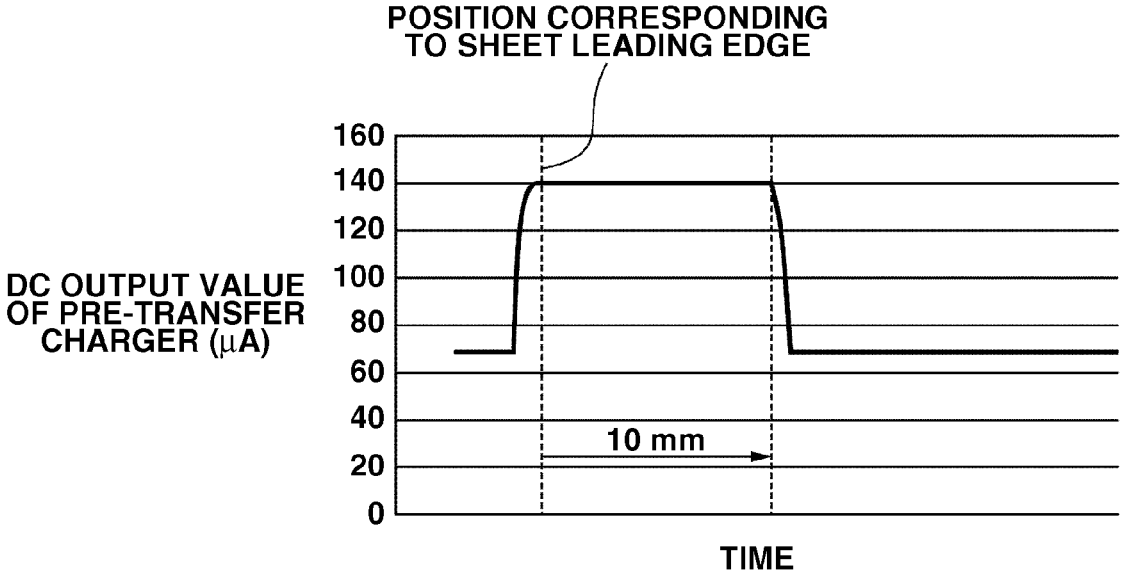
FIG. 11 illustrates a diagram of an output waveform of the pre-transfer charger when the control for the first exemplary embodiment is implemented.

More specifically, the DC bias component of the pre-transfer charging voltage applied to the pre-transfer charger 4 has an output waveform illustrated in FIG. 11. The DC bias component shows a setting value of −140 μA from the position corresponding to the leading edge of the recording material 14 on the photosensitive drum 2 to the position 10 mm apart posterior to the position corresponding to the leading edge of the recording material 14 on the photosensitive drum 2. From the position, the DC bias value continuously changes up to −70 μA.

Figure 9:
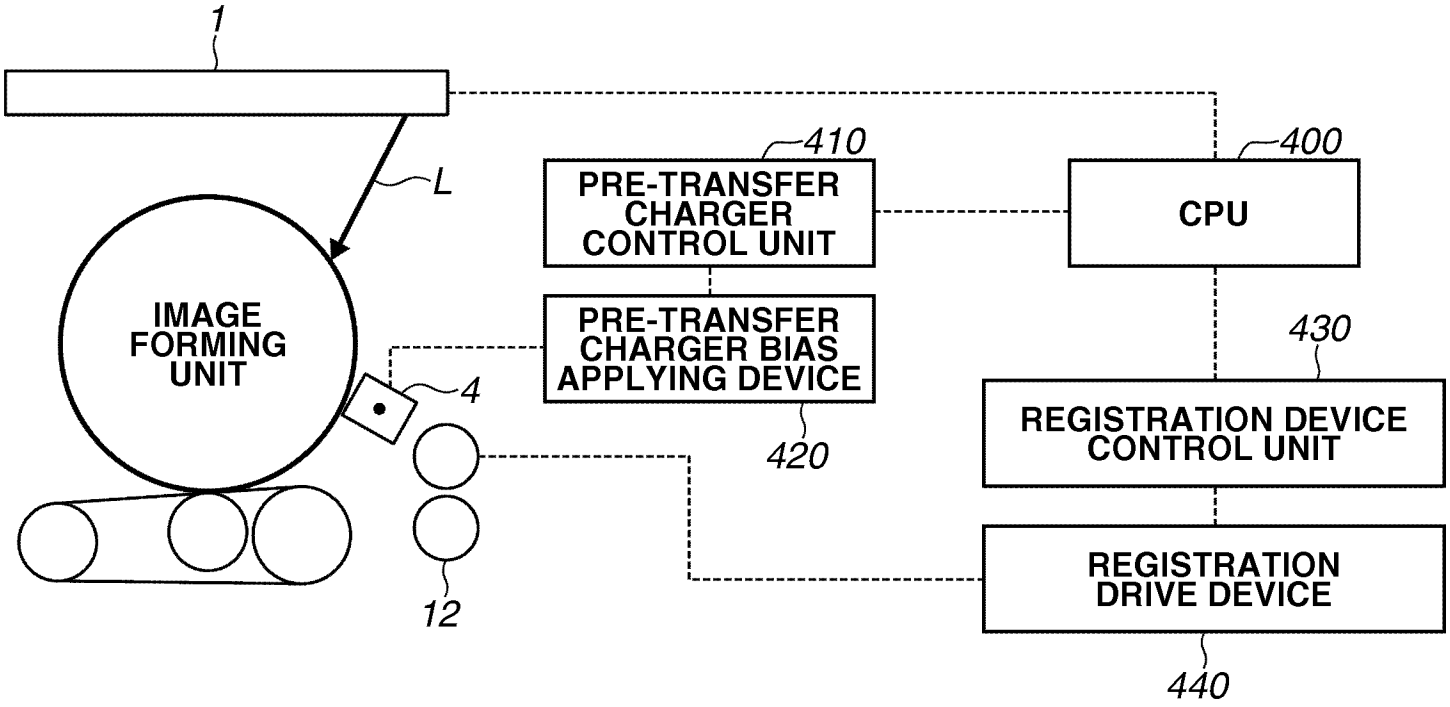
FIG. 9 illustrates a block diagram of control for implementing the first exemplary embodiment.
Figure 10:
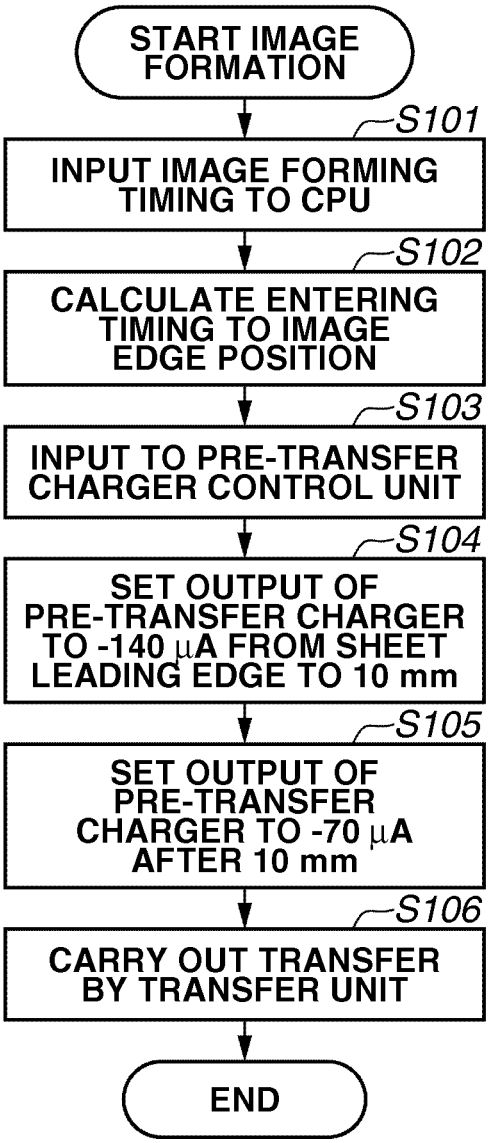
FIG. 10 illustrates a control flowchart for implementing the first exemplary embodiment.

FIG. 9 illustrates a block diagram for performing the control. FIG. 10 is a flowchart of the control. Referring to FIG. 9, the image forming apparatus includes a central processing unit (CPU) 400, and a pre-transfer charger control unit 410. Further, the image forming apparatus includes a pre-transfer charger bias applying device 420 as a voltage applying unit that applies a voltage to the pre-transfer charger 4, a registration device control unit 430, and a registration drive device 440.

The CPU (execution unit) 400 functions as a control unit that entirely controls the image forming apparatus. The pre-transfer charger bias applying device (power supply) 420 functions as a constant-current power supply that performs constant current control of DC bias.

Referring to FIG. 10, when the image forming operation starts, in step S101, an image forming start timing is input to the CPU 400. The image forming is carried out by exposure with the light L. In step S102, an entrance timing is calculated from the image forming start timing to the transfer unit at the position of the leading edge of the image. In step S103, information about the image leading-edge position is input to the pre-transfer charger control unit 410 from the CPU 400. In step S104, in response to an input signal, the pre-transfer charger bias applying device 420 sets an output of the pre-transfer charger 4 to −140 μA starting from the position corresponding to the position of the leading edge of the recording material 14 on the photosensitive drum 2.

In step S105, an output of the pre-transfer charger 4 is reduced to −70 μA at timing that it passes the position of 10 mm. In step S108, the transfer unit finally transfers the toner image to the recording material 14. Then, the processing ends. The transfer voltage is not switched. That is, a predetermined voltage is used as the transfer voltage in a range corresponding to the entire recording material 14. In both a range within which the DC bias component is charged with −140 μA, and a range within which the DC bias component is charged with −70 μA, a value of the transfer voltage is set so that the toner image can be transferred with high efficiency.

According to the present exemplary embodiment, in a range from the position 10 mm apart from the leading edge of the recording material 14 to the trailing edge of the recording material 14, the DC bias component is set to −70 μA. The present invention is not limited to this configuration. For example, the DC bias component can be reduced in front of the trailing edge of the recording material 14.

According to the present exemplary embodiment, in a range of 10 mm from the leading edge of the sheet, the output value Pa of the DC bias component is set to −140 μA. The present invention is not limited to this configuration. In a range from the leading edge of the sheet to a position 5 mm apart (nip length) from the leading edge of the sheet, the output value of the DC bias component of the pre-transfer charger 4 may be reduced. In a range from the position 5 mm apart (nip length) from the leading edge of the sheet to the position 10 mm apart from the leading edge of the sheet, the output value of the DC bias component of the pre-transfer charger 4 should be set to the output value Pa of the DC bias component.

According to the present exemplary embodiment, the output of the DC bias component is maximum in the range from the position 5 mm apart (nip length) from the leading edge of the sheet, to the position 10 mm apart from the leading edge of the sheet. Therefore, the output of the DC bias component is maximum when the range is the half or less of the recording material 14 of the minimum size. This configuration is preferable in view of the lifetime of the pre-transfer charger 4.

(Comparison with Comparative Examples)

TABLE 1

| | DC Output Value of Pre-transfer Charger | Horizontal Line Scattering at Leading Edge | Number of Sheets Until HT Image Unevenness occured |
|---|---|---|---|
| Comparative Example 1 | −70 μA | none | 500K |
| Comparative Example 2 | −140 μA | occured | 200K |
| First Exemplary Embodiment | Up to 10 mm from Leading Edge: −140 μA After 10 mm from Leading Edge: −70 μA | occurred | 460K |

Table 1 illustrates a comparison between Comparative Examples 1 and 2 and the present exemplary embodiment with respect to the phenomenon of horizontal-line scanning on the leading edge side of the recording material 14 and the number of sheets until the image unevenness occurs due to the wire dirt of the pre-transfer charger 4.

Referring to Table 1, in Comparative Example 1, the DC output value of the pre-transfer charger 4 is always set to −70 μA to optimize the transfer efficiency during the image formation. In Comparative Example 2, the DC output value of the pre-transfer charger 4 is always set to −140 μA during the image formation so that the horizontal-line scanning does not occur on the leading edge side of the recording material 14.

As a result, in Comparative Example 1, the number of sheets on which the image unevenness occurred is favorable 500K. However, on the leading edge side of the recording material 14, the horizontal-line scanning occurred. In Comparative Example 2, on the leading edge side of the recording material 14, the horizontal-line scanning did not occur. However, the number of sheets until the image unevenness occurred due to the wire dirt is 200K, i.e., the half or less of the number of sheets until the image unevenness occurred in Comparative Example 1.

On the other hand, according to the present exemplary embodiment, the horizontal-line scanning did not occur on the leading edge side of the recording material 14, and the number of sheets where the occurrence of the image unevenness due to the wire dirt was prevented is 460K. According to the present exemplary embodiment, it was confirmed that the earlier occurrence of the image unevenness due to the wire dirt can be suppressed while suppressing the horizontal-line scanning on the leading edge side of the recording material 14.

A second exemplary embodiment of the present invention is described. Contents overlapped to those according to the first exemplary embodiment are not described. According to the second exemplary embodiment, the pre-transfer charging voltage applied to the pre-transfer charger 4 is set based on whether the recording material 14 conveyed to the transfer unit is a first side or a second side in a two-sided printing mode.

Figure 13:
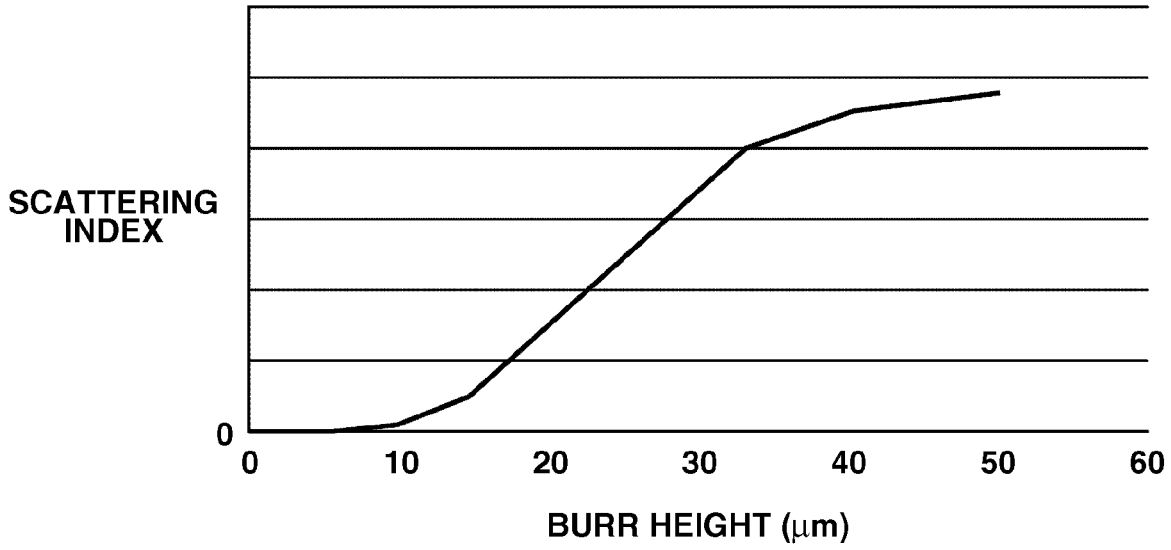
FIG. 13 illustrates a graph of a scattering index relative to a sheet burr height according to the second exemplary embodiment.

The reason for that is described with reference to FIG. 13. The abscissa in FIG. 13 indicates the height of the sheet burr, and the ordinate in FIG. 13 indicates the scattering index. Referring to FIG. 13, the horizontal-line scanning sharply deteriorates around where the height of the sheet burr is over 10 μm. If the height of the sheet burr is less than a certain value, the change amount downward to the transfer conveyance belt 6 is reduced. That is, an undesirable impact made when the sheet burr exits the transfer nip N is small. Therefore, backward toner scattering in the sub-scanning direction is suppressed.

Pressure at the fixing nip is larger than that at the transfer nip N. Therefore, the sheet burr is pressed out at the fixing nip. That is, the height of the sheet burr is reduced when the recording material 14 passes through the fixing nip of the fixing device 11. More specifically, when the height of the sheet burr of the recording material 14 is 30 μm before passing through the fixing nip, the height of the sheet burr after passing through the fixing device 11 is reduced to 10 μm. Therefore, when transferring the image to the second side, the horizontal-line scattering did not occur.

According to the present exemplary embodiment, in the two-sided printing mode, regarding the first side, the DC bias component of the pre-transfer charging voltage is switched (a first mode). On the other hand, regarding the second side in the two-sided printing mode, the DC bias of the pre-transfer charging voltage is not switched (a second mode). The pre-transfer charger control unit 410 executes both the first and second modes. That is, the pre-transfer charger control unit 410 functions as an execution unit that can execute both the first and second modes.

Figure 12:
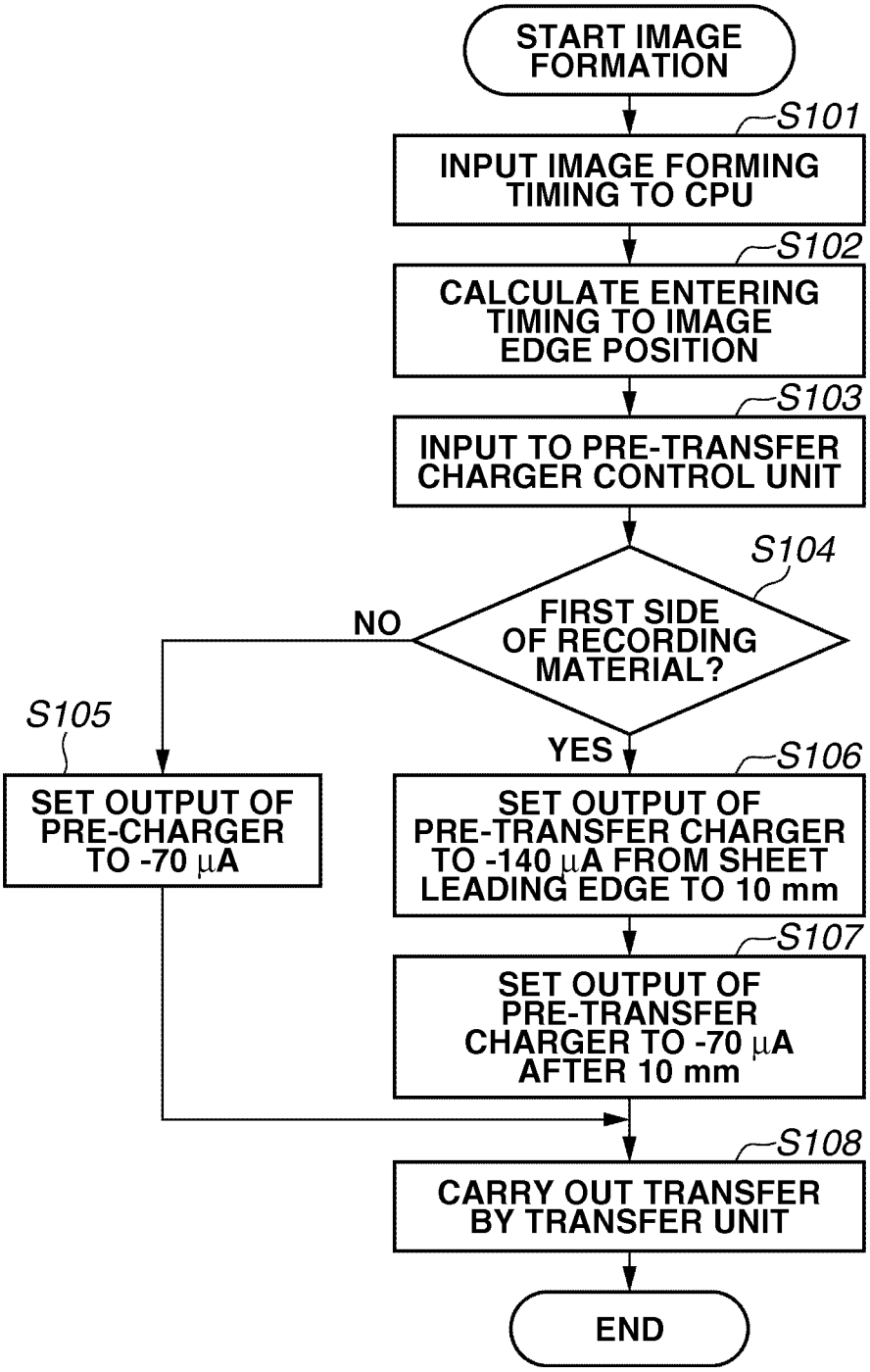
FIG. 12 illustrates a control flowchart for implementing a second exemplary embodiment of the present invention.

FIG. 12 illustrates a flowchart according to the present exemplary embodiment. Steps from S101 to S103 are the same as those according to the first exemplary embodiment. In step S104, it is determined whether data is to be printed on the first side of the recording material 14. If it is determined that the data is not printed on the first side of the recording material 14 (NO in step S104), since the height of the sheet burr is low, the toner scattering due to the sheet burr cannot occur.

In step S105, the DC component is set to −70 μA in a range corresponding to the entire recording material 14 without switching the DC component of the pre-transfer charging voltage. Thus, the increase in voltage applied to the pre-transfer charger 4 is suppressed, and the shortening of lifetime of the wire of the pre-transfer charger 4 is prevented. In step S108, the data is transferred to the recording material 14. Then, the processing ends.

On the other hand, if it is determined that the data is to be printed on the first side of the recording material 14 (YES in step S104), the toner scattering due to the sheet burr can occur. Therefore, in step S106, the DC component is set to −140 μA in the range from the leading edge of the recording material 14 to the position 10 mm apart from the leading edge of the recording material 14. That is, a maximum voltage is set in the range (specific range) including at least the position 5 mm apart from the leading edge of the recording material 14 to the position 10 mm apart from the leading edge of the recording material 14.

In step S107, the DC component is set to −70 μA in a range after the position 10 mm apart from the leading edge of the recording material 14. In step S108, the data is transferred to the recording material 14. Then, the processing ends.

According to the present exemplary embodiment, selection is made based on whether the first side or the second side of the two-sided printing, i.e., the selection is made in a mode of switching the pre-transfer charging voltage or a mode without switching the pre-transfer charging voltage. Therefore, with respect to the second side of the two-sided printing, the increase in pre-transfer charging voltage is suppressed and the shortening of lifetime of the pre-transfer charger 4 is also prevented.

According to the present exemplary embodiment, in step S108, the transfer voltage is set to have a value for transferring the toner image with high efficiency in both the range within which the DC bias component is charged with −140 μA and a range within which the DC bias component is charged with −70 μA.

According to the present exemplary embodiment, the same value is set as the transfer voltage in the mode of switching the pre-transfer charging voltage and the mode without switching the pre-transfer charging voltage. The present invention is not limited to this configuration. A different value can be set as the transfer voltage in the mode of switching the pre-transfer charging voltage and the mode without switching the pre-transfer charging voltage. In this case, in the mode without switching the pre-transfer charging voltage, the transfer voltage can be set corresponding to −70 μA. In the mode of switching the pre-transfer charging voltage, the transfer voltage can be increased.

A third exemplary embodiment of the present invention is described. A portion overlapping with those according to the second exemplary embodiment is not described. According to the third exemplary embodiment, the pre-transfer charging voltage applied to the pre-transfer charger 4 is set based on the type of the recording material 14 conveyed to the transfer unit.

The reason for that is described. A cause for the horizontal-line scattering at the leading edge of the recording material 14 is a burr formed at the sheet leading edge. Depending on the type of the recording material 14 such as an overhead transparency (OHT) sheet or Japanese paper, the sheet can have no sheet burr or only small one. When a specific sheet type is determined in advance by a cassette stage and is selected, the DC bias component of the pre-transfer charging voltage is not switched and the DC bias component is set to −70 μA in a range corresponding to the entire recording material 14. As a consequence, the lifetime of the wire can be further lengthened.

Figure 14:
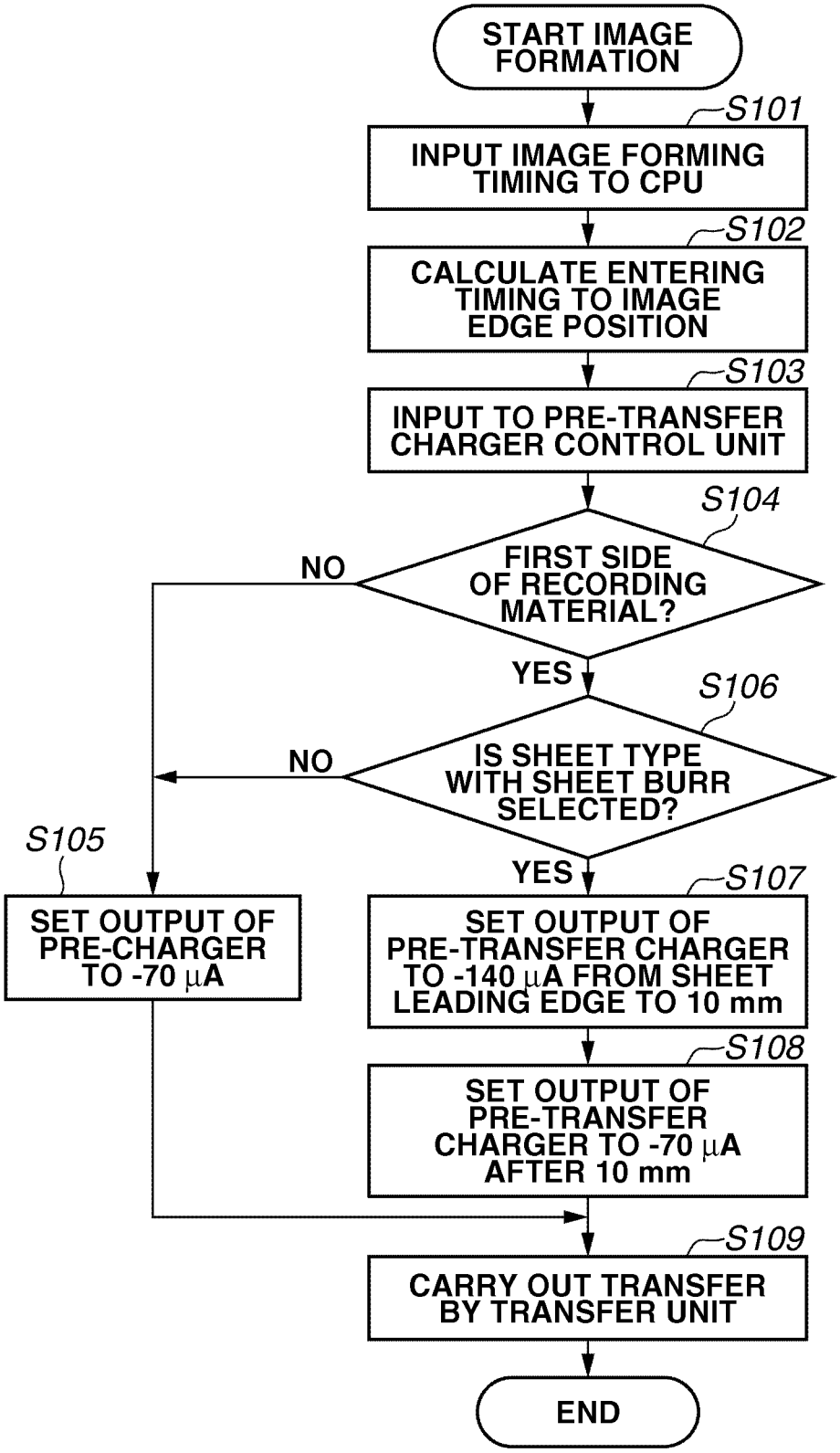
FIG. 14 illustrates a control flowchart according to a third exemplary embodiment of the present invention.

FIG. 14 illustrates a control flowchart according to the present exemplary embodiment. Steps S101 to S105 are the same as those according to the second exemplary embodiment. According to the present exemplary embodiment, in step S104, if it is determined that the printing is performed on the first side of the recording material 14, then in step S106, it is determined whether the type of the recording material 14 selected by a user generates the burr. More specifically, when the recording material 14 selected by the user is a plain sheet, it is determined that the type of the recording material 14 generates the burr (YES in step S106). When it is determined that the recording material 14 selected by the user is an overhead projector (OHP) sheet, the type of the recording material 14 does not generate the burr (NO in step S106).

If it is determined the type of the recording material 14 selected by the user does not generate the burr (NO in step S106), the scattering due to the burr cannot occur. In step S105, the DC bias component of the pre-transfer charging voltage is not switched in the range corresponding to the entire recording material 14, and the DC bias component is set to −70 μA.

On the other hand, in step S106, if it is determined that the recording material 14 selected by the user generates the burr (YES in step S106), the scattering due to the burr needs to be suppressed. In step S107, the DC component is set to −140 μA in a range from the leading edge of the recording material 14 to the position 10 mm apart from the leading edge of the recording material 14. In step S108, in a range after the position 10 mm apart from the leading edge of the recording material 14, the DC component is set to −70 μA. In step S109, the data is transferred to the recording material 14. Then, the processing ends.

Thus, according to the present exemplary embodiment, the mode of switching the pre-transfer charging voltage or the mode without switching the charging voltage is switched over based on the type of the recording material 14. Therefore, if the type of the recording material 14 does not generate the burr, the increase in pre-transfer charging voltage is suppressed and the shortening of lifetime of the pre-transfer charger is also suppressed.

A fourth exemplary embodiment of the present invention is described. A portion overlapping with those according to the third exemplary embodiment is not described. The pre-transfer charging voltage applied to the pre-transfer charger 4 is set based on whether the horizontal line is included within a predetermined range of an output image on the leading edge side.

The reason for that is described. In the phenomenon of the toner scattering due to the burr, the toner is scattered backward. Therefore, if the output image is the horizontal line, the line direction is vertical to the scattering direction of the toner. Thus, the toner scattering is easily visualized, i.e., stands out. Therefore, if the output image is the horizontal line, the toner scattering due to the burr needs to be suppressed.

On the other hand, if the output image is a vertical line, the line direction is in parallel with the scattering direction of the toner, and the toner scattering does not stand out. The mode of switching the pre-transfer charging voltage or the mode without switching is selected based on whether the image of the horizontal line is included within the predetermined range of the recording material 14 on the leading edge side.

Figure 15:
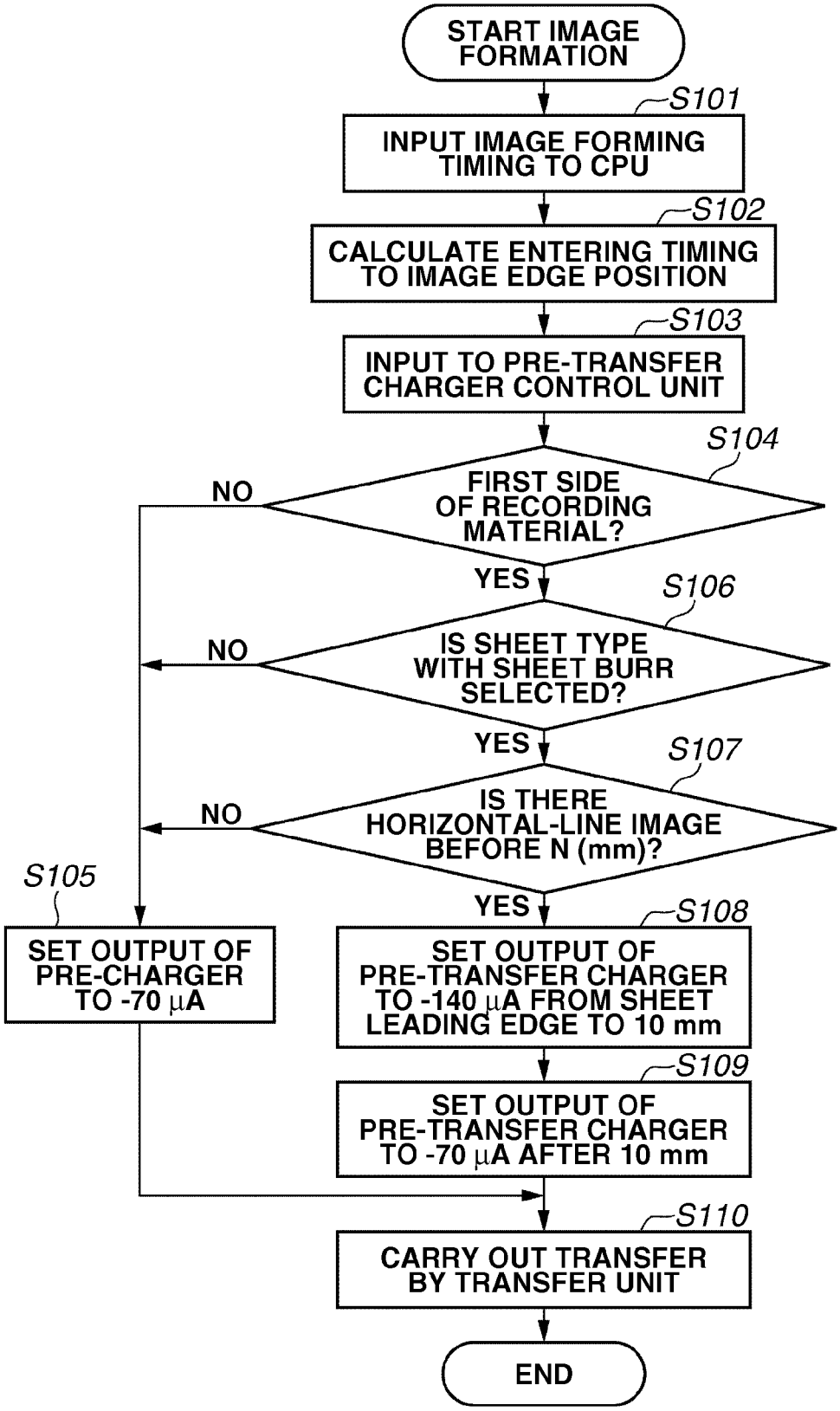
FIG. 15 illustrates another control flowchart according to the third exemplary embodiment.

FIG. 15 illustrates a control flowchart according to the present exemplary embodiment. Steps S101 to S106 are the same as those according to the third exemplary embodiment. According to the present exemplary embodiment, if it is determined that the recording material 14 generates the burr (YES in step S106), the processing advances to step S107. In step S107, it is determined whether the horizontal line is included in an image in a range from the leading edge of the recording material 14 to the position 10 mm apart from the leading edge of the recording material 14. The horizontal line is in parallel with the direction vertical to the movement direction of the image bearing member.

If it is determined that the horizontal line is not included in the image in the range from the leading edge of the recording material 14 to the position 10 mm apart from the leading edge of the recording material 14 (NO in step S107), in step S105, the DC bias component of the pre-transfer charging voltage is not switched in the range corresponding to the entire recording material 14, and the DC bias component is set to −70 μA. On the other hand, in step S107, if it is determined that the horizontal line is included in the image in the range from the leading edge of the recording material 14 to the position 10 mm apart from the leading edge of the recording material 14 (YES in step S107), the scattering due to the burr needs to be suppressed.

In step S108, the DC component is set to −140 μA in the range from the leading edge of the recording material 14 to the position 10 mm apart from the leading edge of the recording material 14. In step S109, the DC component is set to −70 μA in the range after the position 10 mm apart from the leading edge of the recording material 14. In step S110, the data is transferred to the recording material 14. Then, the processing ends.

Figure 16:
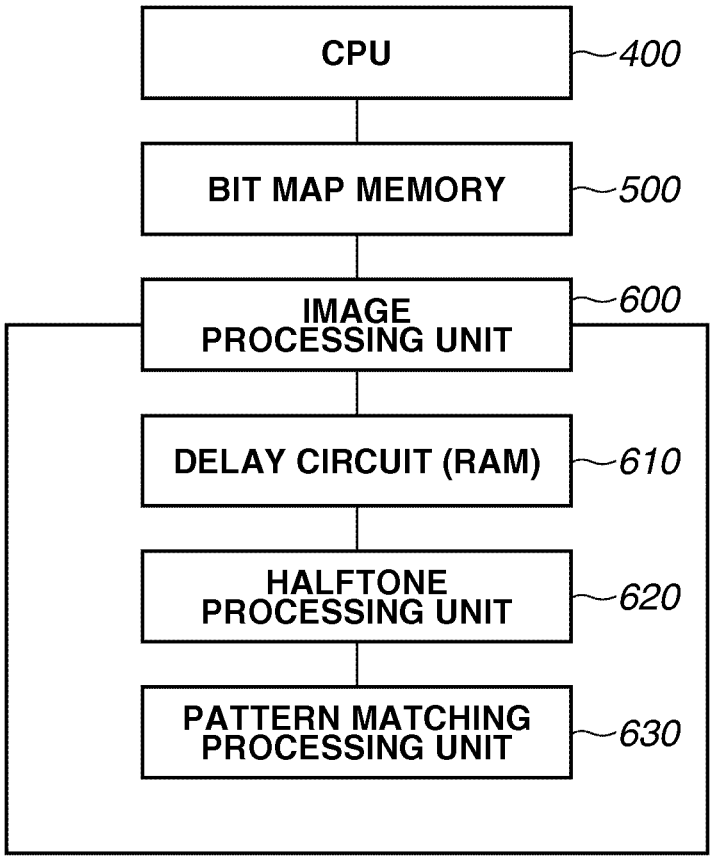
FIG. 16 illustrates a block diagram of a configuration of an image forming apparatus according to a fourth exemplary embodiment of the present invention.

Details of determination as to whether the image includes the horizontal line are described. FIG. 16 illustrates a block diagram according to the present exemplary embodiment. Referring to FIG. 16, the image forming apparatus includes the central processing unit (CPU) 400, a bit map memory 500, and an image processing unit 600. The bit map memory 500 can rasterize a dot image corresponding to one page for printing. The image processing unit 600 performs image processing, and includes an image processing conversion circuit in the image processing unit 600 that determines the image of the horizontal line.

The image processing unit 600 includes a delay circuit (random access memory (RAM)) 610 that captures data about the line image, a halftone processing unit 620, and a pattern matching processing unit 630. Prior to the image forming operation, the bit map memory 500 in the image forming apparatus converts the image information sent to the image forming apparatus into image data on the basis of one pixel unit. The converted image is sent to the image processing unit 600.

The image processing unit 600 performs the image processing according to the processing in FIG. 16. The halftone processing unit 620 and the pattern matching processing unit 630 first extract the line image. As an extraction method of the line image, according to the present exemplary embodiment, a pattern matching method is used. With the pattern matching method, the same pattern as a detection pattern of M×N pixels is extracted from an image. For example, a detection pattern of 4×1 pixels in FIG. 18 is used for an image in FIG. 17.

Figure 17:
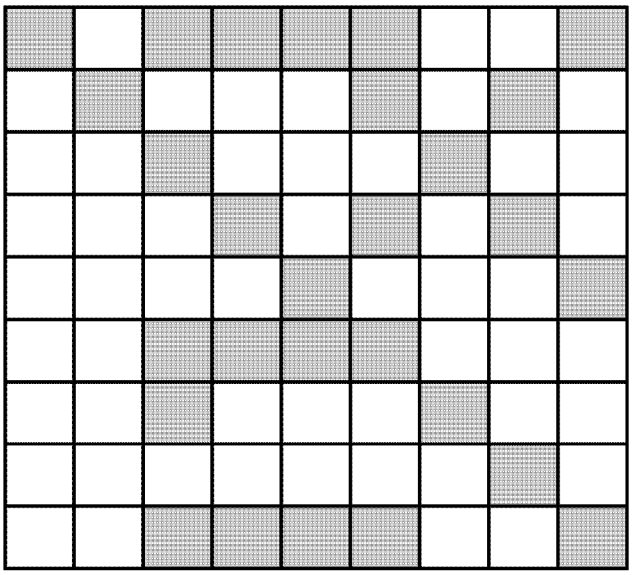
FIG. 17 illustrates a pattern matching processing method according to the fourth exemplary embodiment.
Figure 18:
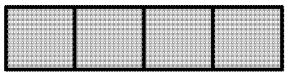
FIG. 18 illustrates another pattern matching processing method according to the fourth exemplary embodiment.
Figure 19:
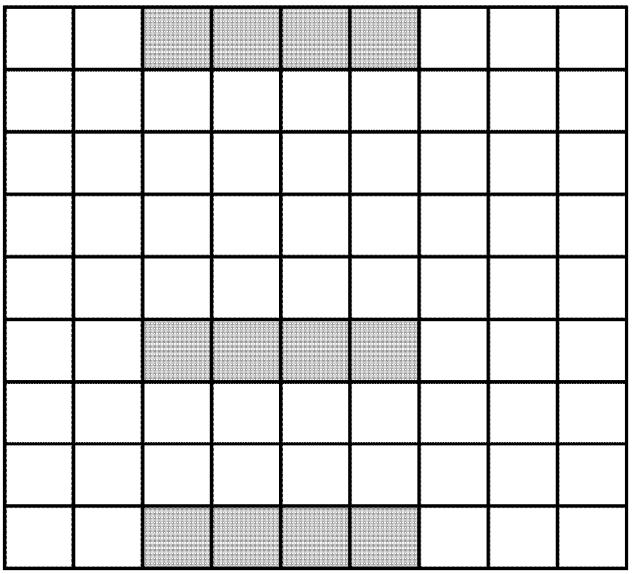
FIG. 19 illustrates another pattern matching processing method according to the fourth exemplary embodiment.

Then, the same pattern as that of an image in FIG. 18 is extracted from the image in FIG. 17. As a consequence, an image in FIG. 19 is extracted. The pattern matching processing unit 630 determines whether the image is the line image, using a replacement pixel (line) determination pattern of 100×100 size pixels. That is, the image processing unit 600 functions as a determination unit that determines whether the horizontal line image is included.

According to the present exemplary embodiment, the pre-transfer charging voltage is switched at the position 10 mm apart from the leading edge of the recording material 14. However, the present invention is not limited to the value according to the present exemplary embodiment.

According to the present exemplary embodiment, based on whether the predetermined range on the leading edge side of the recording material 14 includes the horizontal-line image, the mode of switching the pre-transfer charging voltage or the mode without switching is selected.

The DC bias value of the pre-transfer charger 4 may not be increased more than necessary, and the wire dirt can be reduced. Thus, the shortening of wire lifetime can be suppressed.

The exemplary embodiments of the present invention have been described. However, the present invention is not limited to the exemplary embodiments, and can be modified within the technical spirits of the present invention.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-272763 filed Dec. 13, 2011, which is hereby incorporated by reference herein in its entirety.

What is claimed is:

1. An image forming apparatus comprising:

a movable image bearing member;

an image forming unit configured to form a toner image on the image bearing member;

a pre-transfer charging member configured to charge the toner image of the image bearing member, facing the image bearing member on a downstream side of the image forming unit in a movement direction of the image bearing member;

a power supply configured to apply a voltage to the pre-transfer charging member; and a transfer member configured to form a transfer nip for transferring the toner image of the image bearing member to a recording material by pressing the image bearing member on a downstream side of the pre-transfer charging member in the movement direction of the image bearing member; and an execution unit configured to execute a first mode when a toner image is to be printed on a first side of the recording material, and execute a second mode when a toner image is to be printed on a second side of the recording material, wherein the execution unit sets a voltage of the power supply applied to the pre-transfer charging member as a first voltage in a period during which at least a specific region passes through a position facing the pre-transfer charging member and setting a voltage of the power supply applied to the pre-transfer charging member as a second voltage whose absolute value is lower than that of the first voltage after a second position of the image bearing member passes through the position facing the pre-transfer charging member in the first mode, and the execution unit sets a voltage applied to the pre-transfer charging member as the second voltage without switching the voltage at the second position in the second mode, and wherein a first position is a position of the image bearing member on an upstream side in the movement direction of the image bearing member, apart by a length corresponding to the transfer nip length from a position of the image bearing member overlapping with a leading edge of the recording material at the transfer nip, and the second position is a position on an upstream side at a predetermined distance which is shorter than a length of the recording material, from the first position, and the specific region is a region of the image bearing member between the first position and the second position.

2. The image forming apparatus according to claim 1, wherein the predetermined distance is less than half length of the recording material in the movement direction of the image bearing member.

3. The image forming apparatus according to claim 1, wherein the execution unit executes the first mode when the recording material is a plain sheet, and executes the second mode when the recording material is an overhead projector (OHP) sheet.

4. The image forming apparatus according to claim 1, further comprising:

a determination unit configured to determine whether an image formed on the specific region includes a line intersecting with the movement direction of the image bearing member, wherein the execution unit executes the first mode when the determination unit determines that the image includes the intersecting line, and executes the second mode when the determination unit determines that the image does not include the intersecting line.

5. The image forming apparatus according to claim 1, wherein the power supply can output a voltage waveform obtained by superimposing a DC component on an AC component, the DC component is subjected to constant current control, and the AC component is subjected to constant voltage control.

6. The image forming apparatus according to claim 1, wherein the pre-transfer charging member is a corotron charger or a scorotron charger.

7. The image forming apparatus according to claim 1, wherein a DC component of a voltage of the power supply has the same polarity as the charging polarity of the toner.

8. The image forming apparatus according to claim 1, wherein the first voltage is the highest voltage applied to the pre-transfer charging member in one image.

9. The image forming apparatus according to claim 1, wherein the execution unit sets a voltage of the power supply applied to the pre-transfer charging member as the first voltage while a region of the image bearing member from a position corresponding to the leading edge of the recording material to the second position, passes through the position facing the pre-transfer charging member.

* * * * *